United States Patent [19]

Schiltknecht et al.

[11] Patent Number: 4,601,416

[45] Date of Patent: Jul. 22, 1986

[54] CLOSURE PLATE AND SLIDING CLOSURE UNIT

[75] Inventors: Bruno Schiltknecht, Richterswil; Gebhard Arnold, Lucerne; Otto Kägi, Cham; Robert Fricker, Unterägeri; Beat Troxler, Hildisrieden, all of Switzerland

[73] Assignee: Stopinc Aktiengesellschaft, Baar, Switzerland

[21] Appl. No.: 668,823

[22] Filed: Nov. 6, 1984

[30] Foreign Application Priority Data

Nov. 18, 1983 [CH] Switzerland ..... 6201/83
Aug. 14, 1984 [CH] Switzerland ..... 03900/84

[51] Int. Cl.[4] ..... B22D 41/08
[52] U.S. Cl. ..... 222/600; 222/561
[58] Field of Search ..... 222/600, 561, 559, 598

[56] References Cited

U.S. PATENT DOCUMENTS 4,249,680 2/1981 Kimura et al. ..... 222/600
4,508,241 4/1985 Bauer et al. ..... 222/561

FOREIGN PATENT DOCUMENTS 2411542 8/1979 France ..... 222/600

*Primary Examiner*—Joseph J. Rolla
*Assistant Examiner*—Louise S. Heim
*Attorney, Agent, or Firm*—Wenderoth, Lind & Ponack

[57] ABSTRACT

A sliding closure unit includes at least one stationary plate having therethrough a discharge opening, and a movable plate mounted in sliding contact with the stationary plate, the movable plate having therethrough first and second discharge openings and including a closing area. Guides define alternative first and second paths of movement of the movable plate in directions along respective first and second tracks extending between the closing area and the first and second discharge openings of the movable plate. A single drive is connected to the movable plate for moving the movable plate along a selected such path between a closed position whereat the closing area is aligned with the discharge opening of the stationary plate and a selected open position wherein one of the discharge openings of the movable plate is aligned with the discharge opening of the stationary plate. The guide structure is adjustable when the movable plate is in the closed position thereof, without moving the movable plate, to selectively switch between the first and second paths. The movable plate includes three rectilinear surfaces defining edges of the plate and relatively positioned to extend along the three sides of an imaginary equilateral triangle. Centers of the first and second discharge openings of the movable plate are located on bisectors of respective angles of the imaginary triangle.

20 Claims, 9 Drawing Figures

CLOSURE PLATE AND SLIDING CLOSURE UNIT

BACKGROUND OF THE INVENTION

The present invention relates to an improved refractory closure plate for use as a movable plate in a sliding closure unit and to an improved sliding closure unit employing such closure plate. More particularly, the present invention is directed to such improved closure plate for use in a sliding closure unit of the type including at least one stationary plate having therethrough a discharge opening, the movable plate being mounted in sliding contact with the stationary plate, the movable plate having therethrough first and second discharge openings and including a closing area, and means for moving the movable plate between a closed position, whereat the closing area covers the discharge opening of the stationary plate, and alternate open positions, whereat one or the other of the discharge openings of the movable plate is aligned with the discharge opening of the stationary plate.

This type of sliding closure unit is employed for discharging a molten material from a vessel, particularly for discharging a molten metal from a metallurgical vessel. This type of sliding closure unit, including two or even more discharge openings in the movable closure plate, is employed to achieve relatively long pouring times without the need for changing the closure plates. This is possible with this type of sliding closure unit, since when one of the discharge openings has been worn to an extent to no longer be usable, it is possible to switch to another, still unused discharge opening of the movable closure plate. The discharge openings of the movable closure plate may have the same or different diameters.

A sliding closure unit including a single stationary refractory closure plate and a movable refractory closure plate is disclosed in West German Pat. No. 2,850,183. This structure, as well as all other known structures of sliding closure units, includes a housing having mounted therein a sliding frame operated by a first hydraulic cylinder drive. This sliding frame carries both a swivel frame and a second hydraulic cylinder drive connected therewith. The movable closure plate is held in the swivel frame. The sliding closure unit is operated, i.e. closed, opened or throttled, by the first drive by sliding the sliding frame together with the swivel frame, whereas the second drive is operated to switch from one discharge opening to another discharge opening by pivoting the swivel frame with respect to the sliding frame. During this operation, as during the movement of the sliding frame, the friction of the closure plates, which are locked in place in relation to each other and to other parts of the unit, must be overcome.

It is very expensive both to construct and to operate this known type of sliding closure unit. Both hydraulic drives require appropriate feed lines and independent controls. Furthermore, during the operation of switching between the discharge openings of the movable plate a heavy mass must be moved, i.e. the sliding frame together with the swivel frame and second drive.

SUMMARY OF THE INVENTION

Accordingly, it is an object of the present invention to provide an improved sliding closure unit and an improved movable closure plate incorporated therein whereby it is possible to overcome the above and other prior art disadvantages.

It is a more specific object of the present invention to provide such a sliding closure unit including a movable closure plate having therethrough two discharge openings, whereby switching between the two openings may be achieved with a limited number of controls.

It is an even further object of the present invention to provide such a sliding closure unit and movable closure plate of a design which is considerably simplified compared with prior art arrangements.

These objects are achieved in accordance with one aspect of the present invention by the provision of a sliding closure unit including at least one stationary plate having therethrough a discharge opening, a movable plate mounted in sliding contact with the stationary plate, the movable plate having therethrough first and second discharge openings and including a closing area, and means for moving the movable plate between a closed position, whereat the closing area covers the discharge opening of the stationary plate, and alternate open positions, whereat one or the other of the discharge openings of the movable plate is aligned with the discharge opening of the stationary plate, the improvement wherein the moving means comprises guide means defining alternative first and second paths of movement of the movable plate in directions along respective first and second tracks extending between the closing area and the first and second discharge openings of the movable plate, respectively, single drive means connected to the movable plate for moving the movable plate along a selected of the paths between the closed position and a selected open position, and the guide means being adjustable when the movable plate is in the closed position, without moving the movable plate, to selectively switch between the first and second paths.

Therefore, in accordance with the present invention, the second drive which is necessary in prior art structures for switching between discharge openings of the movable plate is eliminated. This is made possible because switching of the guiding means may occur without moving or changing the position of the movable closure plate when it is in its closed position. Therefore, this switching easily can be done by hand. Furthermore, the structure of the present invention results in a reduced overall height and a smaller moving mass, because it no longer is necessary to provide an arrangement of a sliding frame and a swivel frame superposed thereon. The present invention is suitable equally for two-plate and three-plate sliding closure units.

In accordance with one feature of the present invention, the first and second tracks may extend in straight directions, and the guide means may comprise passive members for controlling movement of the movable plate alternatively in one or the other of the straight directions. The first and second straight tracks intersect and may enclose an angle of 60°.

In one construction, a frame supports the movable plate and is movable therewith, and the guide means further comprises first and second pairs of rectilinear guide surfaces on the frame and extending parallel respectively to the first and second straight tracks. The passive guide members comprise two pivotally mounted guide arms lockable in respective first and second positions to bear against the first and second pairs of guide surfaces, respectively. A link member is pivotally connected to the two guide arms to maintain the guide arms in parallel alignment and is movable therewith between the first and second positions. Means is provided for locking the link member and thereby the two guide arms alternatively at either of the first or second positions.

In accordance with another structural arrangement, a frame also supports the movable plate and is movable therewith, and the guide means further comprises first and second pairs of rectilinear guide slots fixed with respect to the stationary plate and extending parallel respectively to the first and second tracks. The members comprise pins fixed to the frame to extend slidably into either the first or second pairs of guide slots. Means is provided for aligning the pins to extend into a selected pair of slots. Each aligning means comprises a sleeve having therein a radial slot, and each sleeve is mounted for reciprocal rotation about the axis thereof between respective first and second positions whereat the radial slot is aligned with respective slots of the pairs of slots. Levers are fixed to the sleeves, and a link member is pivotally connected to the two levers to maintain the two levers in parallel alignment and is movable therewith and with the sleeves to the respective positions thereof. Means are provided for locking the link member and thereby the levers and sleeves alternatively in either the first or second positions.

In accordance with a further arrangement of the present invention, the first and second tracks are curved along circular arcs of rotation. The guide means comprises means for controlling movement of the movable plate alternatively along one or the other of the curved tracks. A frame supports the movable plate and is movable therewith, and the controlling means comprises two bores fixed at respective positions at centers of rotation of respective of the curved tracks, and pin means extending into a selective one of the bores for mounting the frame and thereby the movable plate for pivotal movement about the respective center of rotation.

The two tracks extend through centers of respective of the discharge openings of the movable plate and intersect at a point of the closing area aligned with the center of the discharge opening of the stationary plate when the movable plate is in the closed position thereof. Accordingly, upon movement of the movable plate from either of the open positions thereof to the closed position thereof, such point of intersection will be aligned with the center of the discharge opening of the stationary plate.

In accordance with a further aspect of the present invention, there is provided an improved closure plate for use as the movable plate of the sliding closure unit. The movable plate has therethrough first and second discharge openings and also includes a closing area spaced from the discharge openings.

West German Pat. No. 2,850,183 discloses a movable closure plate having a sector shape and mounted in a swivel frame which pivots about a pin located far outside the surface of the plate. The plate includes two discharge openings which extend in separate tracks running beside one another to a closing area of the plate. Accordingly, the plate must have a substantial width.

In contrast to such arrangement, the movable closure plate of the present invention has edges defined by three rectilinear surfaces which are relatively positioned to extend along the three sides of an imaginary equilateral triangle. Centers of the first and second discharge openings are located on bisectors of respective angles of such triangle. By this structural arrangement, the movable plate may have a smaller surface than the above prior art arrangement, with given diameters of the two discharge openings and with a given distance therebetween. Furthermore, the closing area of the movable plate may be employed by both discharge openings. Adjacent ends of the rectilinear edge surfaces of the plate are joined or merged by curved edge surfaces defined by circular arcs, two of these arcs being concentric with respective of the discharge openings. The radius of the third arc may be the same as, smaller than or larger than the radii of these two arcs. The closing area of the movable plate is located on the bisector of the third angle of the triangle. Furthermore, there may be provided a gas inlet device for introducing gas into the closing area, for example for treating or preventing solidification of molten material in the discharge opening of the stationary plate when the movable plate is in the closed position thereof.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
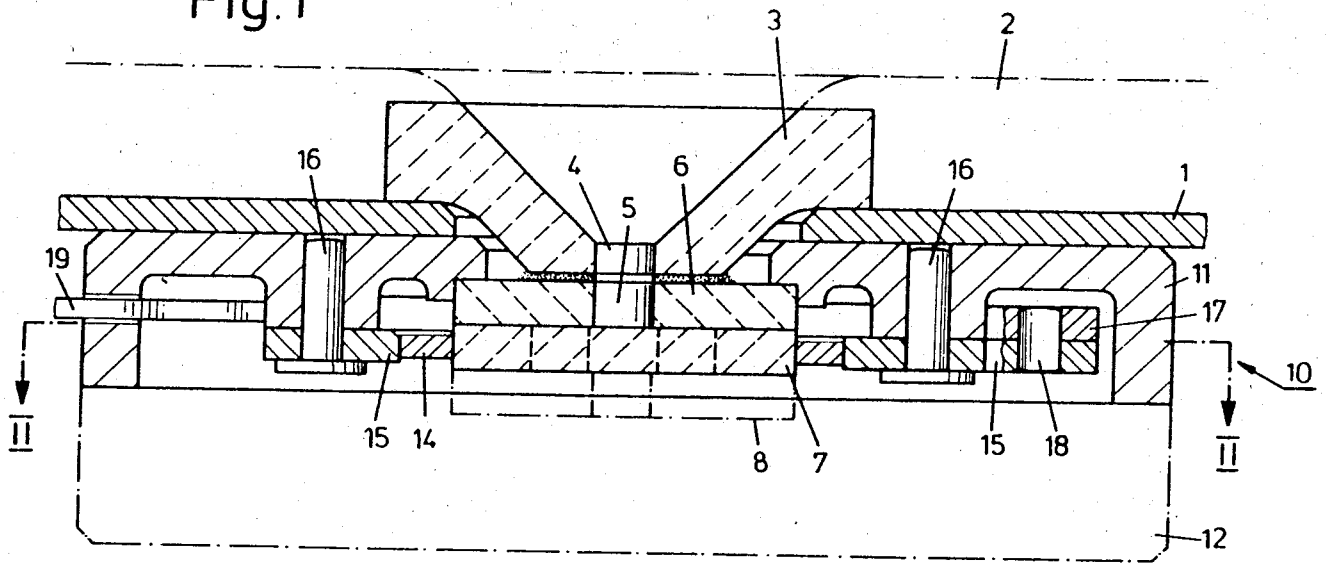
FIG. 1 is a simplified cross-sectional view taken along line I—I of FIG. 2 of a three-plate slide closure unit according to the present invention, shown schematically mounted on a metallurgical vessel.
Figure 2:
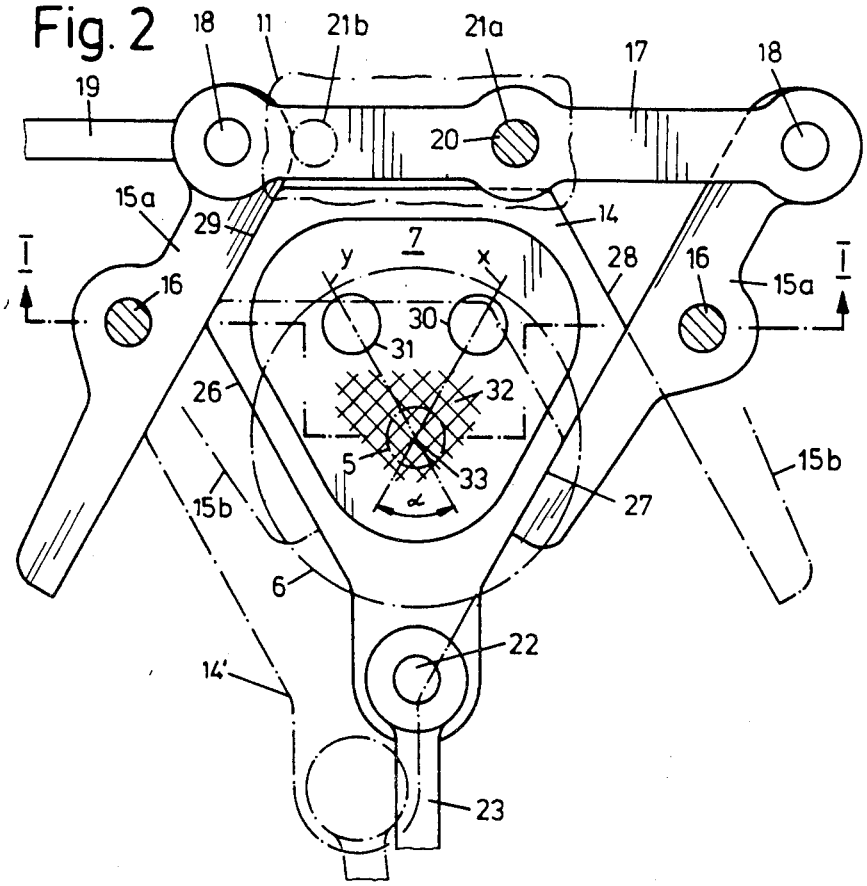
FIG. 2 is a cross-sectional view taken along line II—II of FIG. 1, but without the housing shown in FIG. 1, illustrating the elements of a sliding closure unit according to a first embodiment of the present invention.

FIGS. 1 and 2 illustrate a sliding closure unit according to a first embodiment of the present invention, and specifically shown as being of the three-plate type. The unit is affixed in a known manner to the bottom of a molten material vessel, for example a tundish of a continuous casting machine. Only an outer metal jacket 1 and a refractory lining 2 of the vessel are shown in FIG. 1. The lining includes a refractory perforated brick 3 extending through an opening in outer jacket 1. A discharge hole 4 of brick 3 forms the beginning of a controllable flow channel extending downwardly through the sliding closure unit for discharge of molten material, for example molten metal, from the vessel.

The sliding closure unit is indicated generally at 10 in FIG. 1 and includes an upper housing 11 attached in a known manner to jacket 1 of the vessel. To control the flow of molten metal from the vessel, the sliding closure unit includes three refractory closure plates, namely, stationary top plate 6 having therethrough a discharge opening 5 aligned with discharge hole 4 and fixedly positioned in upper housing 11, a center movable plate 7, and a bottom stationary plate 8 having therethrough a discharge opening aligned with discharge opening 5. Bottom stationary plate 8 is a component of a removably attached bottom portion 12 of known construction of the sliding closure unit and is illustrated in FIG. 1 by phantom lines only since the construction thereof is not essential for understanding of the present invention. From the bottom portion 12 or in some other known manner, the three closure plates are clamped together so that the center movable plate 7 is permanently in sliding contact with the two stationary plates 6, 8.

The movable closure plate 7 is mounted in a metal supporting frame 14 and forms therewith the slide gate of the sliding closure unit. A linear drive is fixed to frame 14 by means of a pivot pin 22. In the illustrated arrangement, this linear drive is in the form of a hydraulic cylinder 24 pivotally mounted at 25 to a fixed structure (FIG. 3) and including a piston rod 23 pivotally connected at 22 to frame 14.

Movable plate 7 has extending therethrough two discharge openings 30, 31 of, in the normal manner, circular configuration. Spaced from these discharge openings is a closing area 32 of the plate 7 as indicated by hatching in FIG. 2. In the closed position of the movable plate, closing area 32 is located between and blocks the discharge openings of the top and bottom stationary plates. By operation of the hydraulic cylinder 24, and employing the novel guiding means of the present invention, to be discussed in more detail below, the movable plate 7 and frame 14 are moved between a closed position, whereat the closing area 32 covers the discharge openings of the stationary plates, and alternate open positions, whereat one or the other of the discharge openings 30, 31 of movable plate 7 is aligned with the discharge openings of the stationary plates, thereby enabling the discharge of the molten metal from the vessel. Needless to say, intermediate throttling positions can be provided by appropriate control of the drive cylinder 24.

It is contemplated that, as is known, the discharge opening or openings of the bottommost plate be followed immediately by a refractory discharge sleeve (not shown). It should be noted that, although FIG. 1 illustrates a sliding closure of the three-plate type, the present invention equally is applicable to a sliding closure unit of the two-plate type, i.e. without a bottom stationary plate, and whereby the refractory discharge sleeve would be mounted on the movable plate.

In accordance with the embodiment of FIGS. 1 and 2 of the present invention, two guide arms 15 are pivotally mounted by respective pins 16 to upper housing 11 to serve as passive guides for the movement of movable plate 7 and frame 14. Guide arms 15 form stationary, i.e. fixed, track guides for movement of plate 7. Arms 15 are connected at respective ends thereof, for example by pivot pins 18, to a link member 17 which maintains the two arms extending parallel to each other. The guide arms 15 and link member 17 can be switched from a first position shown at **15*a* in solid lines in FIG. 2 to a second position 15*b* indicated by dashed lines in FIG. 2. Thus, a locking pin 20 can be inserted into appropriately positioned locking bores 21*a* or 21*b* provided in upper housing 11. This switching of positions of arms 15 and link member 17 is conducted when the movable plate 7 is in the closed position thereof shown by solid lines in FIG. 2. Furthermore, this switching is achieved without any movement whatsoever of the movable plate and frame 14 and is achieved when these elements are stationary. Accordingly, switching easily may be achieved by hand, for example by employing a lever 19 fastened to link member 17 and extending through housing 11. If necessary, lever 19 may be employed to remove pin 20 from one of the locking bores and inserting it into the other locking bore. It is to be understood however that guide arms 15** may be moved from one locked position thereof to the other locked position thereof by any other suitable structure.

Supporting frame 14 is provided with two pairs of parallel rectilinear guide surfaces 26, 28 and 27, 29. Guide arms 15 cooperate with these pairs of guide surfaces to guide movement of the frame 14 and plate 17. Thus, in the position shown by solid lines in FIG. 2, guide arms 15 cooperate with surfaces 27, 29, and in the dashed line positions shown in FIG. 2 the guide arms cooperate with surfaces 26, 28. The structure of guide arms and the pairs of guide surfaces of frame 14 define alternative first and second paths of movement of movable plate 7 and frame 14 in directions along respective first and second tracks x, y extending between closing area 32 and first and second discharge openings 30, 31, respectively. These tracks extend parallel to respective guide surfaces of frame 14 and arms 15. That is, track x extends parallel to guide surfaces 27, 29, and track y extends parallel to guide surfaces 26, 28.

Figure 4:
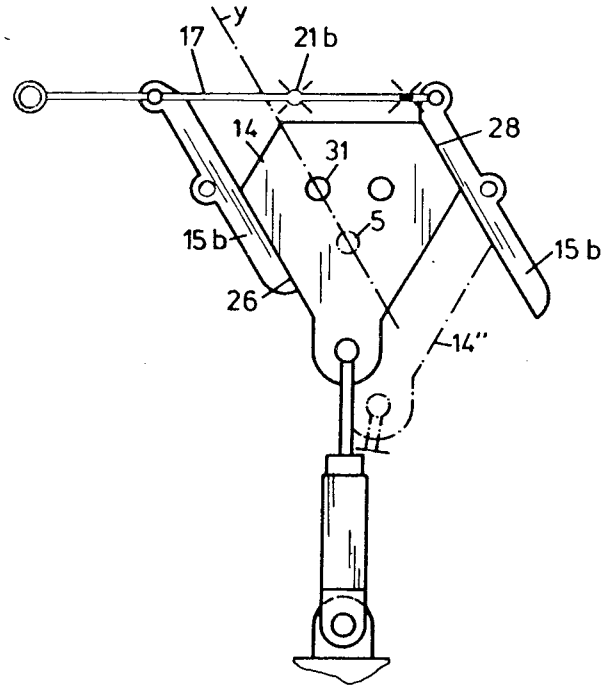
FIGS. 3 and 4 are schematic simplified views illustrating the manner of operation of the apparatus of FIGS. 1 and 2.
Figure 3:
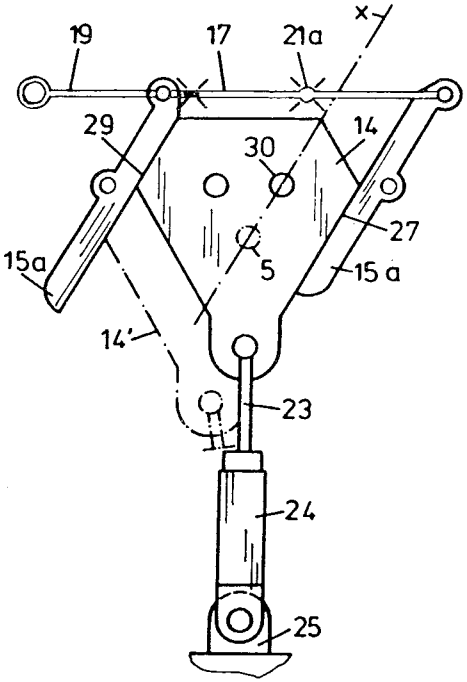

FIGS. 3 and 4 illustrate the manner of movement of the frame 14 and movable plate 7 in the directions of the respective tracks x, y by means of the drive 24. Thus, when the arms 15 and link member 17 are in the position shown in FIG. 3, operation of drive 24 moves frame 14 and movable plate 7 in the direction along track x between the closed position shown at 14, wherein discharge opening 5 of the stationary plate is blocked by the closing area of the movable plate, and open position 14' whereat first discharge opening 30 of movable plate 7 is aligned with discharge opening 5. Alternatively, as shown in FIG. 4, when the arms 15 and link member 17 are in the alternative locked positions thereof, then operation of drive 24 moves frame 14 and plate 7 in the direction of track y between a closed position 14 and an open position 14" whereat second discharge opening 31 of plate 7 is aligned with discharge opening 5 of the stationary plate.

In accordance with the present invention, switching of the arms 15 and link member 17 between the two final locked positions thereof shown in FIGS. 3 and 4 is achieved with the frame 14 and movable plate 7 in the closed position thereof. Furthermore, this switching is achieved without any movement whatsoever of the plate 7 and frame 14. Accordingly, such switching may be achieved without the application of any appreciable force necessary to overcome the friction between the movable plate and the stationary plate or plates. Furthermore, in accordance with this arrangement of the present invention, the only element which undergoes pivoting movement is drive cylinder 24 which undergoes a slight pivotal deflection about mount 25. The other elements of the unit move only in rectilinear directions.

Very favorable conditions result if the guiding structure is arranged such that the directions of tracks x, y enclose an angle $\alpha$(FIG. 2) of 60°. Furthermore, it is of advantage if for a given length of stroke of the movable plate, the two tracks x, y pass through the centers of bores 30, 31 and intersect each other at a point 33 of closing area 32 such that the same portion of the closing area is employed as a closed position for each of the discharge openings 30, 31. In other words, the point of intersection of tracks x, y is aligned with the center of discharge opening 5 of the stationary plate when the movable plate is in the closed position. Accordingly, upon movement of the movable plate from either of the open positions thereof to the closed position thereof, such point of intersection will be aligned with the center of discharge opening 5.

Figure 5:
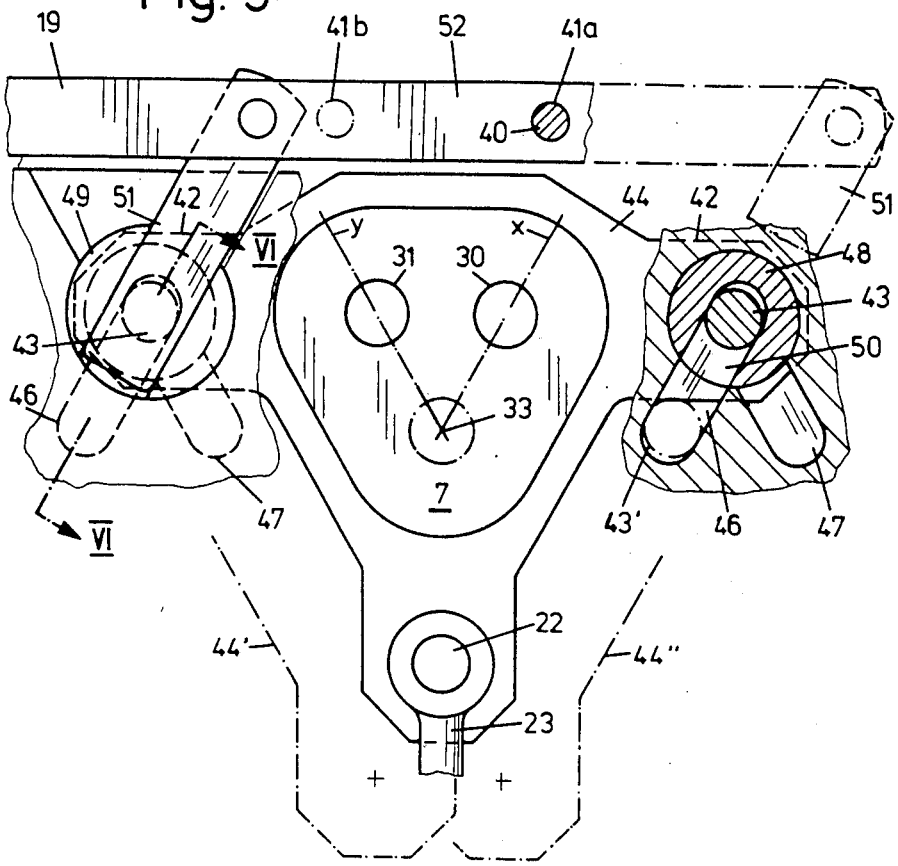
FIG. 5 is a similar to FIG. 2, but of a second embodiment of a sliding closure unit according to the present invention.
Figure 6:
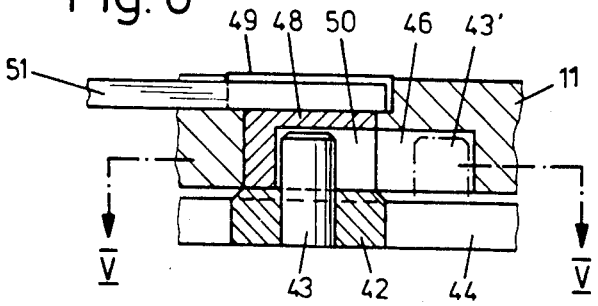
FIG. 6 is a cross-sectional view taken along line VI—VI of FIG. 5.

FIGS. 5 and 6 illustrate a modified arrangement wherein the track guiding structure is different and wherein the frame 44 for supporting plate 7 has a different structure. Otherwise, the overall design of the sliding gate unit of this embodiment corresponds to that of the embodiment of FIGS. 1–4, and like elements are designated by like reference numerals.

Thus, in the embodiment of FIGS. 5 and 6, the guide structure includes first and second pairs of rectilinear guide slots 46, 47 fixed with respect to the stationary plate, and specifically provided in housing 11. Guide slots 46 extend in directions parallel to track x, and guide slots 47 extend in directions parallel to track y. A pair of pins 43 are mounted in opposite shoulders 42 of supporting frame 44, each pin engaging in one slot of a respective pair of slots. There is provided structure for aligning the pins 43 to extend into a selected pair of slots. This aligning structure comprises a pair of sleeves 48 mounted for reciprocal rotation about the axes thereof in housing 11. Each sleeve 48 is provided with a radial slot 50, and upon rotation of each sleeve 48 about the axis thereof, slot 50 may be aligned with the respective slot 46 or the respective slot 47. In the positions illustrated in FIGS. 5 and 6, slots 50 are aligned with slots 46, such that pins 43 are movable therein in directions parallel to track x. Alternatively, slots 50 could be aligned with respective slots 47, such that pins 43 would be slidable therein in directions parallel to track y. Levers 51 are connected to respective sleeves 48, and a link member 52 is pivotally connected to levers 51 to maintain the two levers and thereby the slots 50 of respective sleeves 48 in parallel alignment. Link member 52 and levers 51 may be moved to respective final locked positions thereof by means of lever 19 in a manner similar to that of the embodiment of FIGS. 1–4. Thus, a pin 40 may be inserted into respective bores 41*a* or 41*b* of housing 11. Switching between these two final locked positions always occurs with the movable plate 7 in the closed position thereof, shown by solid lines in FIG. 5, whereby the pins 43 always are housed within slots 50. This switching occurs without any movement whatsoever of the movable plate 7 or frame 44.

Depending upon the final position of the aligning sleeves 48 and the radial slots 50 thereof, the slots 46 or 47 will guide movement of frame 44 and plate 7 upon operation of drive 24. When the slots 50 are aligned with slots 46, then upon operation of the drive 24 to move the plate to one open position thereof, then the plate will move in the direction of track x, whereby first discharge opening 30 will be aligned with discharge opening 5 of the stationary plate, i.e. position 44'. Alternatively, when slots 50 are aligned with slots 47, then movement will be in the direction of track 7 to the position 44'' whereat second discharge opening 31 will be aligned with discharge opening 5.

As shown in FIG. 5, the two pins 43 approximately lie on a straight line connecting the two centers of discharge openings 30, 31 with the result that the corresponding positions of elements 48, 50 and 46, 47 of the guide structure are correspondingly determined. However, the stationary guide structure and also the pins 43 could be positioned in a different location, for example on the axis of symmetry of the slide gate, i.e. elements 7 and 44, which passes through pin 22. Furthermore, it is to be understood that the aligning structure for directing each guide pin 43 to one slot or the other could have a different construction.

Figure 8:
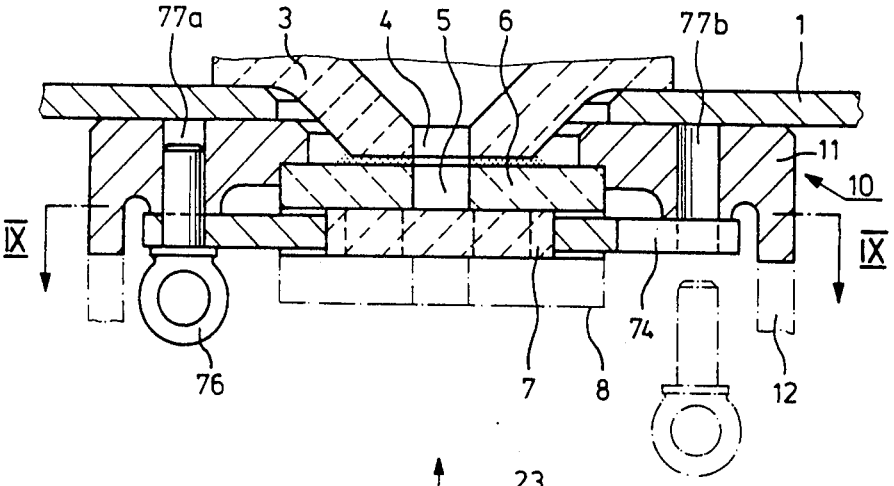
FIG. 8 is a simplified cross-sectional view, similar to FIG. 1, of another embodiment of a sliding closure unit according to the present invention, and taken along line VIII—VIII of FIG. 9.
Figure 9:
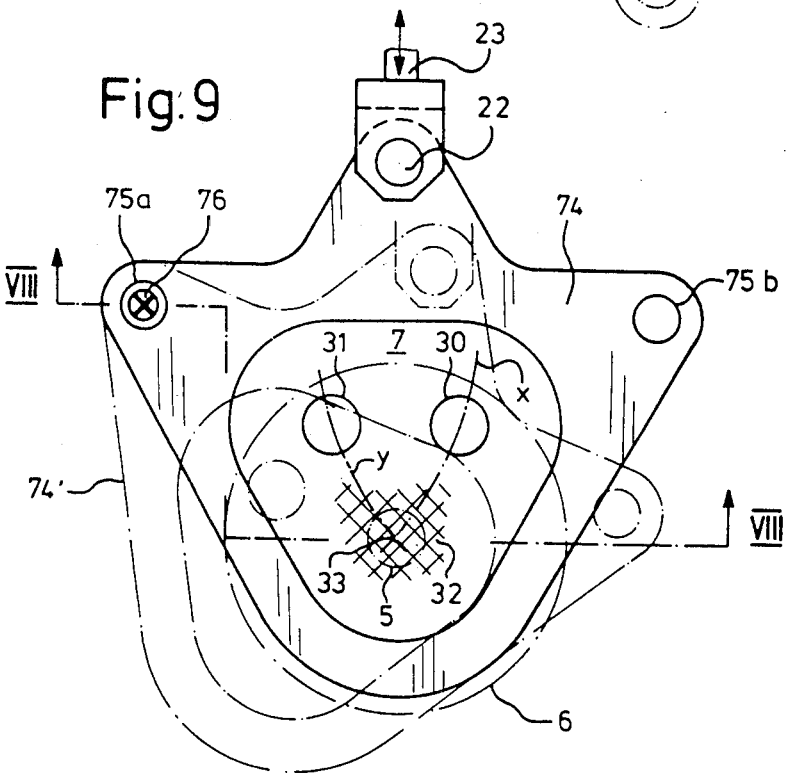
FIG. 9 is a cross-section view taken along line IX—IX of FIG. 8, but without the housing.

The embodiment of FIGS. 8 and 9 differs from the above embodiments in that tracks x, y, rather than being rectilinear are curved. Otherwise, the general construction of the sliding closure unit is similar to that of the previous embodiments, and like elements are denoted in FIGS. 8 and 9 by like reference numerals.

Movable plate 7 is mounted in a metal supporting frame 74 and forms therewith a slide gate of the sliding closure unit. A single linear drive, for example a hydraulic cylinder piston unit, of which only piston rod 23 is shown, is affixed to supporting frame 74 by means of a pin 22. Spaced from discharge openings 30, 31 is closing area 32 indicated by hatching. This closing area, in the closed position shown by the solid lines in FIG. 9, closes the discharge port 5 of the stationary plate or plates.

In the illustrated arrangement, the guide structure for displacement of the movable plate 7 is such that curved tracks x, y extend along circular arcs of rotation defined by the centers of bores 75*a*, 75*b* formed in frame 74 and adapted to be axially aligned with appropriate respective bores 77*a*, 77*b* formed in housing 11. A swivel pin 76 can be inserted alternatively in aligned bores 75*a*, 77*a*, whereby the unit will pivot in the direction of track x, as shown at 74', or in aligned bores 75*b*, 77*b*, whereat pivoting will be in the direction of track y. Thus, depending upon which pair of axially aligned bores receives the pin 76, movement of the drive will cause pivoting movement of the frame 74 and plate 7 in the directions of track x or track y. The two tracks x, y intersect at point 33 on the axis of center of stationary discharge port 5 when the plate 7 is in the closed position thereof shown by solid lines in FIG. 9. To ensure in the respective open position an accurate positioning of opening 30 or opening 31 with opening 5, one or the other pivoting directions of motion of the plate 7 can be limited by appropriate, possibly adjustable stop or abutment structure for the frame 74 (not shown).

Preferably, as will be apparent from FIG. 9, the point of hinging, i.e. pin 22, between the linear drive and the frame 74 occurs on a central axis of symmetry of the unit between bores 75*a*, 75*b*. However, it is possible to provide a different hinging point, if the direction of driving force does not pass through one of such bores.

In the present embodiment, as in the embodiments previously described, switching of the guide structures 75, 76, 77 to achieve motion along one or the other of tracks x, y occurs when the plate 7 is in the closed position thereof, i.e. when both pairs of bores 75*a*, 77*a* and 75*b*, 77*b* are in axial alignment. The pin 76 then easily can be removed from one pair of aligned bores and inserted into the other pair of aligned bores. This can be achieved by means of a suitable actuating lever or the like. Needless to say, a suitable device is provided for locking the pin in the respective pair of aligned bores.

Figure 7:
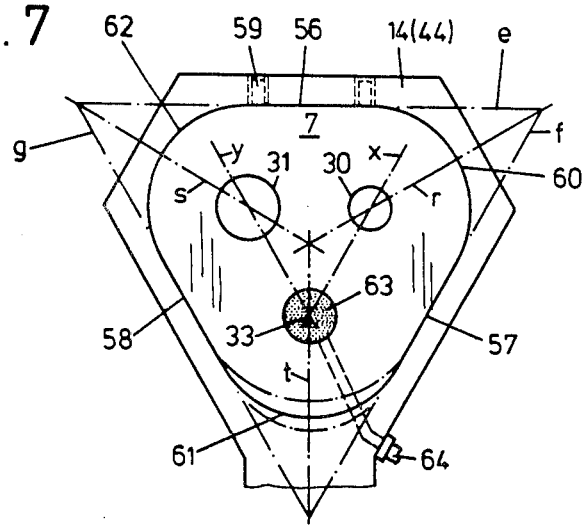
FIG. 7 is a plan view showing details and geometric properties of a moving closure plate according to the present invention.

Reference now will be made to FIG. 7 which illustrates dimensional and geometrical features of the refractory movable plate 7 of the present invention. In FIG. 7, the diameters of the two openings 30, 31 are different. However, it is to be understood that the diameters of these two openings could be the same. Tracks x, y pass through the centers of openings 30, 31, respectively. These tracks may be rectilinear as shown or curved as in the embodiment of FIGS. 8 and 9. The tracks intersect at point 33 corresponding to a closed position for each opening along the respective track.

In the closing area, i.e. at the point of intersection 33, the movable plate 7 may be provided with gas inlet structure for introducing gas into the closing area, for example for the purpose of treating the molten metal or for preventing solidification of molten metal in the discharge opening of the top stationary plate. This structure includes a device 63, for example of known construction, connected to a gas conduit connection 64 extending through the frame.

FIG. 7 also indicates various geometric relationships of the plate surface and plate edges to enable the plate 7 to be properly positioned within metal frame 14, 44, 74. Thus, the plate 7 has three rectilinear surfaces 56, 57, 58 defining edges of the plate and relatively positioned to extend along the three sides e, f, g of an imaginary equilateral triangle. Furthermore, the centers of bores 30, 31 are located on the plate surface to lie on bisectors r, s of respective angles of the triangle. The corners of plate 7 may be beveled. Advantageously however, the adjacent ends of rectilinear surfaces 56, 57, 58 are joined by curved edge surfaces 60, 61, 62 defined by circular arcs. Two of these circular arcs define respective surfaces 60, 62 which have equal radii and which are concentric with respective discharge openings 30, 31. The circular arc defining the third curved surface 61 may have the same radius, but alternatively may have a greater or smaller radius, thereby providing a structural configuration such that the plate 7 may be inserted into the frame in only one position. In the arrangement illustrated in FIG. 7, plate 7 is secured in the respective frame by means of set screws 59 provided in a leg of the frame to press against straight surface 56, such that straight surfaces 57, 58 of the plate are urged against the other two legs of the frame. It will be understood however that plate 7 may be releasably fixed in its frame by means of different structures.

In the geometric shape illustrated in FIG. 7, the directions of motion or tracks x, y extend parallel to rectilinear surfaces 57, 58, respectively. Furthermore, the point of intersection 33 of the two tracks is located on a bisector t of the third angle of the imaginary triangle.

Based on preset diameters and stroke lengths of the slide gate motion, the form described above permits optimum utilization of the refractory material subjected to wear by the molten material. The center of the closed position or point of intersection 33 and the centers of openings 30, 31 also form an equilateral trangle which is surrounded on all sides by the rim of the plate surface having substantially the same width therearound.

Although the present invention has been described and illustrated with respect to preferred embodiments and features thereof, it is to be understood that various changes and modifications as will be apparent to those skilled in the art may be made to the specifically described and illustrated structural arrangements without departing from the scope of the present invention.

We claim:

1. In a sliding closure unit for discharging a molten material from a vessel and of the type including at least one stationary plate having therethrough a discharge opening, a movable plate mounted in sliding contact with said stationary plate, said movable plate having therethrough first and second discharge openings and including a closing area, and means for moving said movable plate between a closed position, whereat said closing area covers said discharge opening of said stationary plate, and alternate open positions, whereat one or the other of said discharge openings of said movable plate is aligned with said discharge opening of said stationary plate, the improvement wherein said moving means comprises:

guide means defining alternative first and second paths of movement of said movable plate in directions along respective first and second tracks extending between said closing area and said first and second discharge openings of said movable plate, respectively;

single drive means connected to said movable plate for moving said movable plate along a selected said path between said closed position and a selected said open position; and said guide means being adjustable when said movable plate is in said closed position, without moving said movable plate, to selectively switch between said first and second paths.

2. The improvement claimed in claim 1, wherein said first and second tracks extend in straight directions, and said guide means comprises members for controlling movement of said movable plate alternatively in one or the other of said straight directions.

3. The improvement claimed in claim 2, wherein said first and second tracks intersect and enclose an angle of 60°.

4. The improvement claimed in claim 2, further comprising a frame supporting said movable plate and movable therewith, and wherein said guide means further comprises first and second pairs of rectilinear guide surfaces on said frame and extending parallel respectively to said first and second tracks, and said members comprise two pivotally mounted guide arms lockable in respective first and second positions to bear against said first and second pairs of guide surfaces, respectively.

5. The improvement claimed in claim 4, further comprising a link member pivotally connected to said two guide arms to maintain said guide arms in parallel alignment and movable therewith between said first and second positions, and means for locking said link member and thereby said two guide arms alternatively at either of said first or second positions.

6. The improvement claimed in claim 2, further comprising a frame supporting said movable plate and movable therewith, and wherein said guide means further comprises first and second pairs of rectilinear guide slots fixed with respect to said stationary plate and extending parallel respectively to said first and second tracks, and said members comprise pins fixed to said frame to extend slidably into either said first or second pairs of guide slots, and means for aligning said pins to extend into a selected said pair of slots.

7. The improvement claimed in claim 6, wherein each said aligning means comprises a sleeve having therein a radial slot, each said sleeve being mounted for reciprocal rotation about the axis thereof between respective first and second positions whereat said radial slot is aligned with respective said slots of said pairs of slots.

8. The improvement claimed in claim 7, further comprising levers fixed to respective said sleeves, and a link member pivotally connected to said two levers to maintain said two levers in parallel alignment and movable therewith and with said sleeves to said respective positions thereof, and means for locking said link member and thereby said levers and said sleeves alternatively in either said first or second positions.

9. The improvement claimed in claim 1, wherein said first and second tracks are curved along circular arcs of rotation, and said guide means comprises means for controlling movement of said movable plate alternatively along one or the other of said curved tracks.

10. The improvement claimed in claim 9, further comprising a frame supporting said movable plate and movable therewith, and wherein said controlling means comprises two bores fixed at respective positions at centers of rotation of respective said curved tracks, and pin means for extending into a selected one of said bores for mounting said frame and thereby said movable plate for pivotal movement about the respective said center of rotation.

11. The improvement claimed in claim 1, wherein said unit comprises a three-plate unit including two spaced said stationary plates with said movable plate mounted therebetween.

12. The improvement claimed in claim 1, wherein said two tracks extend through centers of respective said discharge openings of said movable plate and intersect at a point of said closing area aligned with the center of said discharge opening of said stationary plate when said movable plate is in said closed position, such that upon movement of said movable plate from either of said open positions thereof to said closed position thereof, said point will be aligned with said center of said discharge opening of said stationary plate.

13. The improvement claimed in claim 1, wherein said movable plate is defined by three rectilinear edge surfaces relatively positioned to extend along the three sides of an imaginary equilateral triangle, and the centers of said first and second discharge openings are located on bisectors of respective angles of said triangle.

14. The improvement claimed in claim 13, wherein adjacent ends of said rectilinear edge surfaces are joined by curved edge surfaces defined by circular arcs, two of said arcs being concentric with respective said discharge openings.

15. The improvement claimed in claim 14, wherein the radius of the third said arc is different from the radii of said two arcs.

16. The improvement claimed in claim 13, wherein said closing area is located on the bisector of the third angle of said triangle, and further comprising gas inlet means for introducing gas into said closing area.

17. A closure plate for use as a movable plate in a sliding closure unit and comprising:

first and second discharge openings extending through said plate;

a closing area spaced from said discharge openings;

three rectilinear surfaces defining edges of said plate and relatively positioned to extend along the three sides of an imaginary equilateral triangle; and centers of said first and second discharge openings being located on bisectors of respective angles of said triangle.

18. A plate as claimed in claim 17, wherein adjacent ends of said rectilinear edge surfaces are joined by curved edge surfaces defined by circular arcs, two of said arcs being concentric with respective said discharge openings.

19. A plate as claimed in claim 18, wherein the radius of the third said arc is different from the radii of said two arcs.

20. A plate as claimed in claim 17, wherein said closing area is located on the bisector of the third angle of said triangle, and further comprising gas inlet means for introducing gas into said closing area.

* * * * *